US012280299B1

(12) United States Patent
Tang

(10) Patent No.: US 12,280,299 B1
(45) Date of Patent: Apr. 22, 2025

(54) RECHARGEABLE BASEBALL CORE

(71) Applicant: Tianpei Tang, Zhangzhou (CN)

(72) Inventor: Tianpei Tang, Zhangzhou (CN)

( * ) Notice: Subject to any disclaimer, the term of this patent is extended or adjusted under 35 U.S.C. 154(b) by 0 days.

(21) Appl. No.: 18/938,421

(22) Filed: Nov. 6, 2024

(51) Int. Cl.
*A63B 43/06* (2006.01)

(52) U.S. Cl.
CPC ..... *A63B 43/06* (2013.01)

(58) Field of Classification Search
CPC ..... A63B 43/06
See application file for complete search history.

(56) References Cited

U.S. PATENT DOCUMENTS 3,804,411 A * 4/1974 Hendry ..... A63B 43/06 446/439
5,490,047 A * 2/1996 O'Rourke ..... A63B 43/06 362/361
5,725,445 A * 3/1998 Kennedy ..... A63B 43/007 473/570
6,042,487 A * 3/2000 Schrimmer ..... A63B 43/06 473/370
6,142,894 A * 11/2000 Lee ..... A63B 43/06 473/570
6,428,432 B1 * 8/2002 Kachel ..... A63B 43/06 473/570
6,666,782 B1 * 12/2003 Wu ..... A63H 33/22 446/485
8,727,918 B1 * 5/2014 Gentile ..... A63B 43/06 473/588
D825,464 S * 8/2018 Xie ..... D13/119
10,159,874 B1 * 12/2018 Lin ..... A63B 37/12
D911,930 S * 3/2021 Xie ..... D13/103
D933,590 S * 10/2021 Wu ..... D13/103
11,559,725 B1 * 1/2023 Ayal ..... A63B 43/06
11,739,896 B2 * 8/2023 Zhang ..... H01M 50/291 362/157
2001/0049311 A1 * 12/2001 Lewis ..... A63B 43/06 473/570
2007/0173349 A1 * 7/2007 Eng ..... A63B 37/0003 473/570
2011/0244981 A1 * 10/2011 Schrimmer ..... A63B 43/06 473/570
2016/0043585 A1 * 2/2016 Zawadzki ..... H02J 7/0068 320/137
2016/0354646 A1 * 12/2016 Wang ..... A63B 43/06
2017/0065856 A1 * 3/2017 Lin ..... A63B 69/0002
(Continued)

*Primary Examiner* — Steven B Wong
(74) *Attorney, Agent, or Firm* — JEEN IP LAW, LLC

(57) ABSTRACT

A rechargeable baseball core is provided, which includes a luminous ball and a cover covering a surface of the luminous ball. The luminous ball includes a housing, a luminous component, and a battery component. The luminous component is provided on the housing and configured for luminescent. The battery component includes a battery shell and a battery module. The battery shell is fixedly provided on the housing and is made of fire-resistant material. The battery shell is provided with a protection chamber and a connection groove that is penetrated through. The connection groove communicates to the protection chamber, and the battery module is clamped and fixed to the protection chamber and electrically connected to the luminous component through wires in the connection groove. The present application has an effect of reducing losses caused by battery self-ignition.

9 Claims, 9 Drawing Sheets

(56) References Cited

U.S. PATENT DOCUMENTS

| | | | | |
|---|---|---|---|---|
| 2020/0139203 | A1* | 5/2020 | Lin | A63B 43/06 |
| 2021/0197032 | A1* | 7/2021 | Lin | F21V 3/063 |
| 2024/0335705 | A1* | 10/2024 | Liang | A63B 43/06 |

* cited by examiner

RECHARGEABLE BASEBALL CORE

TECHNICAL FIELD

The present disclosure relates to the field of baseball technologies, and in particular, to a rechargeable baseball core.

BACKGROUND

Whenever the general public needs sports, ball games are always one of the most important choices. Taking the baseball as an example, it is loved by the general public in both Asia and the United States, and the throwing and catching of baseball is simple and fun, which can achieve both sports and leisure effects. It is particularly suitable for leisure time between brothers, fathers, and friends at home. However, during the day, there is always a period of time for work and study. Therefore, unless it is a holiday, baseball is usually played at night or in the evening. In addition, for teams composed of ordinary amateur players, it is common to practice the ball until night, rendering the baseball with luminous characteristics very important.

At present, a baseball structure with luminous function includes a transparent inner ball and a covering material covering the surface of the inner ball to form a surface structure of the baseball. An outer peripheral surface of the inner ball is provided with a receiving space along a radial direction, and a luminous device is set in the receiving space to emit light from the baseball. The luminous device is penetrated through the receiving space and connected and fixed to the inner ball. The luminous device is equipped with a battery compartment, which is directly electrically connected to the luminous device.

Regarding the relevant technologies mentioned above, a direct electrical connection between the battery and the luminous device can easily lead to self-ignition of the battery. The flame generated by the self-ignition of the battery ignites the luminous device, and finally sprays out from the receiving space to ignite the entire baseball, which can cause greater losses.

SUMMARY

In order to reduce the losses caused by battery self-ignition, the present application provides a rechargeable baseball core.

The rechargeable baseball core provided in the present application adopts the following technical solution.

The rechargeable baseball core, including a luminous ball and a cover covering a surface of the luminous ball; the luminous ball includes a housing, a luminous component, and a battery component; the luminous component is provided on the housing and configured for luminescent; the battery component includes a battery shell and a battery module; the battery shell is fixedly provided on the housing and is made of fire-resistant material; the battery shell is provided with a protection chamber and a connection groove that is penetrated through; the connection groove communicates to the protection chamber, and the battery module is clamped and fixed in the protection chamber and electrically connected to the luminous component through wires in the connection groove.

By adopting the above technical solution, when the battery module self-ignites due to being hit or vibrating, flame generated by the self-ignition of the battery module is isolated by a fireproof characteristic of the battery shell, rendering it difficult for the flame generated by the self-ignition of the battery module to ignite the battery shell and continue to spread, thus achieving a goal of preventing flame spread. This improves a direct electrical connection between the battery and the luminous device, which can easily cause the flame generated by the self-ignition of the battery to ignite the luminous device when the battery self-ignites. Finally, it sprays out from a receiving space and ignites the entire baseball, which can easily cause greater losses. At the same time, when temperature in the battery chamber is too high, it is easy to melt wires that are electrical connection between the battery module and the luminous component, thereby achieving automatic power-off protection for overheating of the battery component, rendering it more user-friendly.

In some embodiment of the present application, the battery shell includes a first shell part and a second shell part, the first shell part is fixedly provided with a first protrusion and provided with a first recess, the second shell part is fixedly provided with a second protrusion and provided with a second recess, when the first shell part abuts against the second shell part, the first shell part is penetrated through and clamp fixed in the second recess, and the second protrusion is penetrated through and clamp fixed in the second recess.

In some embodiment of the present application, the first shell part is provided with a plurality of first fixing holes that are penetrated through, and the second shell part is provided with a plurality of second fixing holes that are penetrated through; when the second shell part abuts against the first shell part, each of the second fixing holes corresponds to and communicates with each of the first fixing holes; the first shell part and the second shell part are both fixed to the housing by a fastener, each fastener is simultaneously penetrated through each of the first shell part and the second shell part and fixedly connected to the housing, and each fastener is tightly abutted against the second shell part.

In some embodiment of the present application, the battery component further includes a sponge pad, the sponge pad is provided between the battery module and the battery shell, one side of the sponge pad abuts against the battery shell, and the other side of the sponge pad abuts against the battery module.

By adopting the above technical solution, by providing with the sponge pad, a force is transmitted from the housing to the battery module when the baseball is used and hit, it is buffered by the sponge pad, thereby improving the seismic performance of the battery module and enhancing its usability.

In some embodiment of the present application, at least one reinforcing rib is fixedly provided in the housing.

In some embodiment of the present application, the housing includes a surface housing and a bottom housing, the reinforcing rib includes a first reinforcing portion and a second reinforcing portion, the first reinforcing portion is provided on the surface housing, the second reinforcing portion is provided on the bottom housing; the first reinforcing portion is fixedly provided with a reinforcing protrusion, the second reinforcing portion is provided with a reinforcing recess, when the surface housing is connected to the bottom housing, the reinforcing protrusion is penetrated through the reinforcing recess.

In some embodiment of the present application, the luminous component includes a first luminous plate and a second luminous plate, the first luminous plate and the second luminous plate are respectively located on two sides of the battery shell, the first luminous plate and the second luminous plate are both abutted against the battery shell, and the first luminous plate and the second luminous plate are both electrically connected to the battery module.

By adopting the above technical solution, the first luminous plate and the second luminous plate are respectively located on two sides of the battery shell, rendering a distribution of light emitted by the luminous component more uniform and symmetrical, thereby improving a luminous effect of the baseball and enhancing its usability.

In some embodiment of the present application, the housing is provided with a first clamp groove, the first luminous plate is penetrated through and clamp fixed in the first clamp groove, the battery shell is provided with a second clamp groove, and the second luminous plate is penetrated through and clamp fixed in the second clamp groove.

In some embodiment of the present application, the first luminous plate is electrically connected with an on-off switch and a charging module, the housing is provided with a switch port and a charging port, the on-off switch is penetrated through the switch port, the charging module is penetrated through the charging port, the luminous component further includes a rubber protection block, the rubber protection block includes a switch protection part and a charging protection part, the switch protection part and the charging protection part are fixedly connected, and the switch protection part is fixedly connected to the housing and abuts against the on-off switch, the charging protection part closes the charging port.

In some embodiment of the present application, a center of gravity of the luminous ball is coincided with a center of the luminous ball.

In summary, the present application includes at least one beneficial technical effect as follows.

When the battery module self-ignites due to being hit or vibrating, flame generated by the self-ignition of the battery module is isolated by the battery shell due to its fireproof properties, rendering it difficult for the flame generated by the self-ignition of the battery module to ignite the battery shell and continue to spread, thus achieving a goal of preventing flame spread. This improves a direct electrical connection between the battery and the luminous device, which can easily cause the flame generated by the self-ignition of the battery to ignite the luminous device, and finally spray out from a receiving space and ignites the entire baseball, which can cause greater losses. At the same time, when temperature in the battery chamber is too high, it is easy to melt an electrical connection between the battery module and the luminous component, thereby achieving automatic power-off protection for overheating of the battery component and improving its usability.

Numeral reference: 1—luminous ball; 11—housing; 111—surface housing; 1111—fixed groove; 1112—first clamp groove; 1113—switch port; 1114—charging port; 1115—protection groove; 112—bottom housing; 1121—fixed protrusion; 113—reinforcing rib; 1131—first reinforcing portion; 11311—reinforcing protrusion; 1132—second reinforcing portion; 11321—reinforcing recess; 12—luminous component; 121—first luminous plate; 122—on-off switch; 123—charging module; 124—rubber protection block; 1241—switch protection part; 1242—charging protection part; 125—second luminous plate; 13—battery component; 131—battery shell; 1311—protection chamber; 1312—connection groove; 1313—first shell part; 13131—first protrusion; 13132—first recess; 13133—first fixing hole; 1314—second shell part; 13141—second clamp groove; 13142—second protrusion; 13143—second recess; 13144—second fixing hole; 132—battery module; 133—sponge pad; 2—cover; 21—skin; 211—gap; 212—sewing holes; 22—sewing line; 31—XY plane; 32—XZ plane; 33—YZ plane.

DESCRIPTION OF EMBODIMENTS

Further, a detailed explanation of the present application will be provided in combination with FIGS. 1-9.

Figure 1:
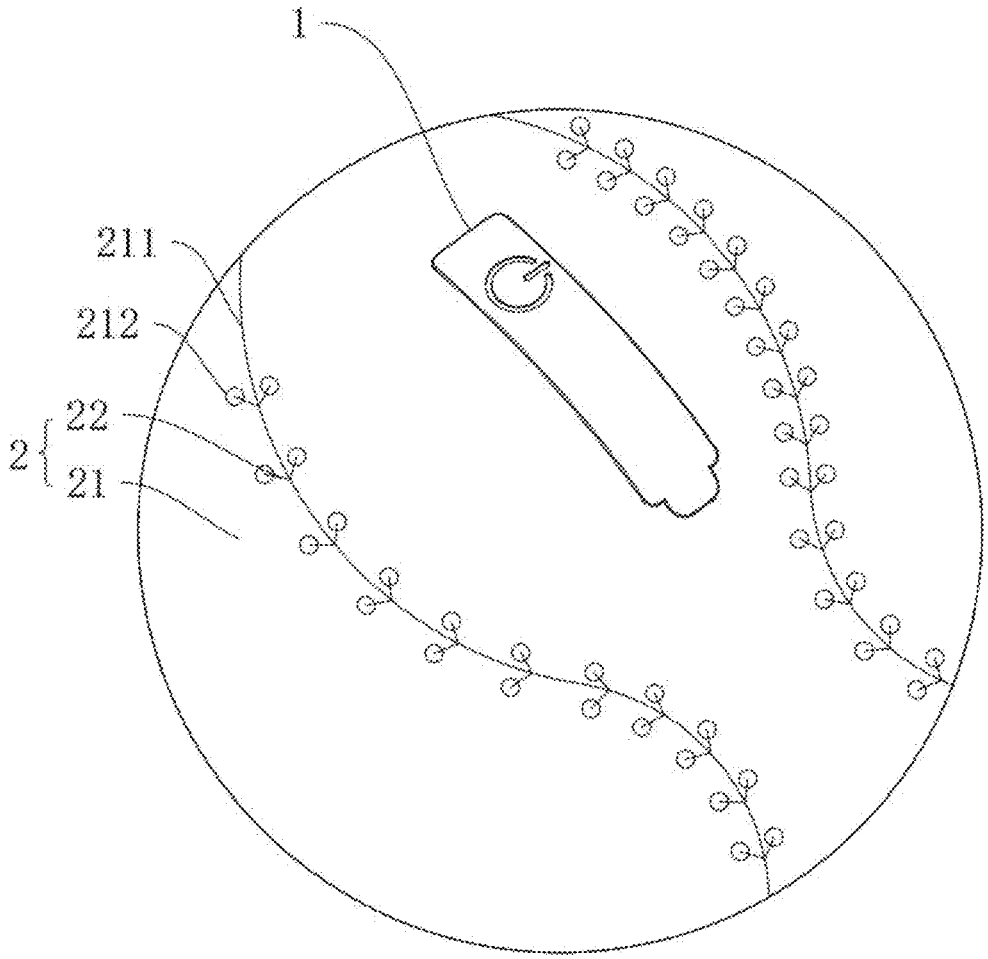
FIG. 1 is a schematic diagram of an overall structure of an embodiment of the present application.
Figure 2:
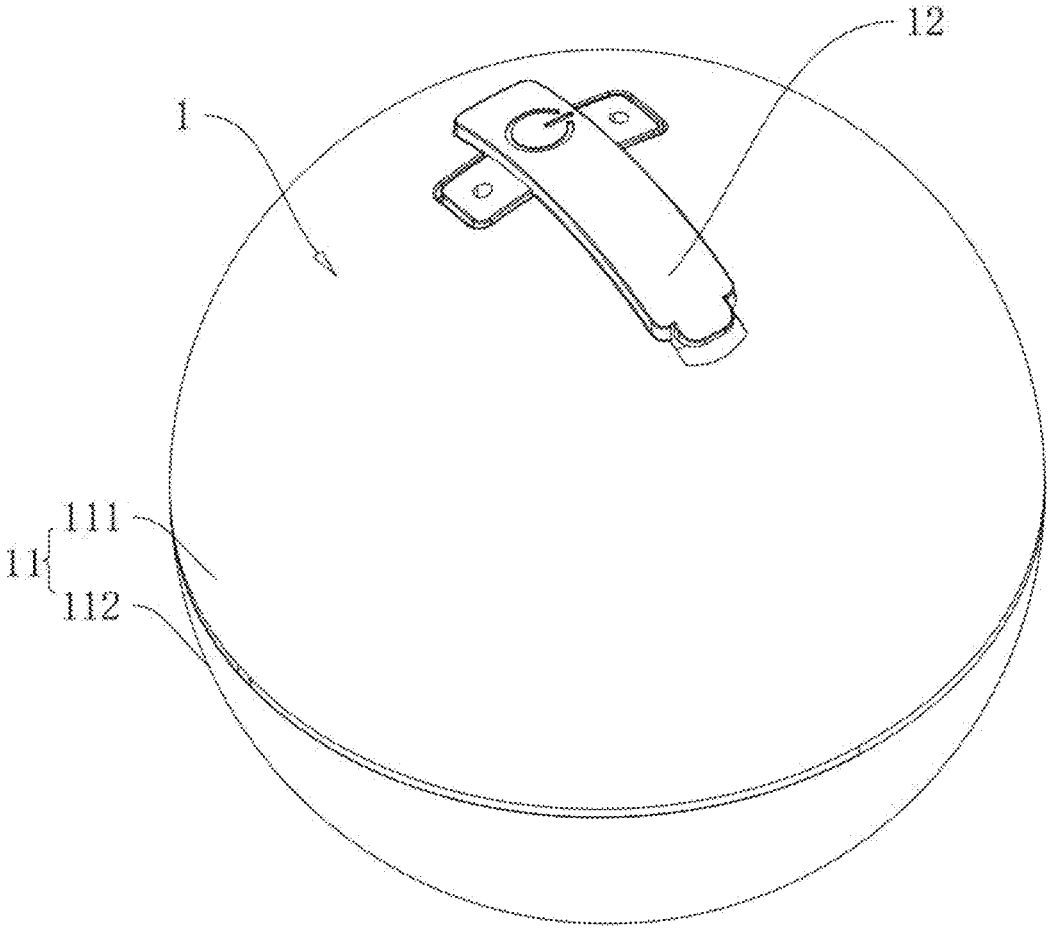
FIG. 2 is a schematic diagram of an overall structure of a luminous ball in an embodiment of the present application.
Figure 3:
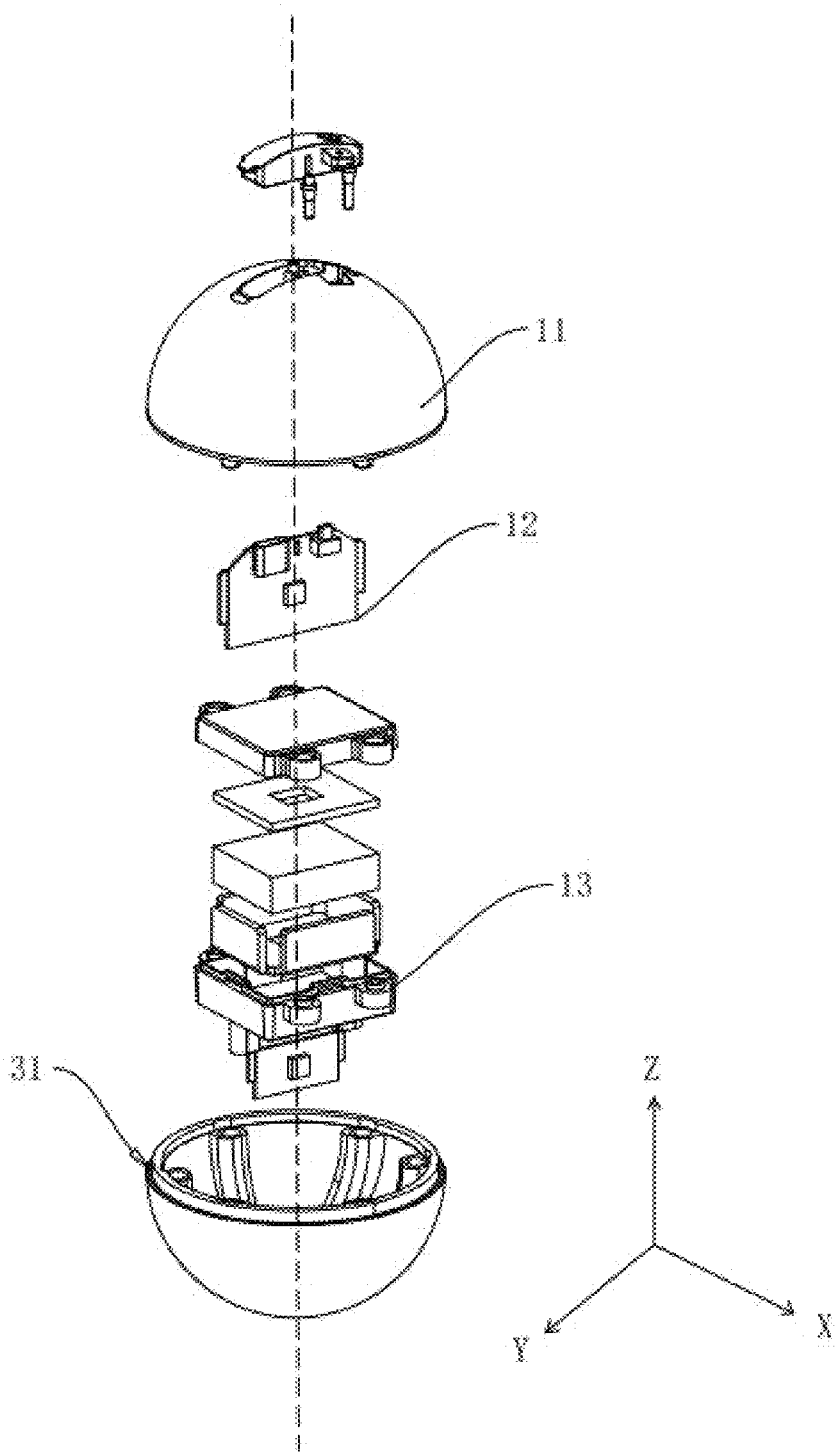
FIG. 3 is an exploded view of the luminous ball in an embodiment of the present application.

An embodiment of the present application discloses a rechargeable baseball core. Referring to FIGS. 1 and 2, the rechargeable baseball core includes a luminous ball 1 and a cover 2 covering a surface of the luminous ball 1. Referring to FIG. 3, the luminous ball 1 includes a housing 11, a luminous component 12, and a battery component 13. The housing 11 is a transparent sphere, the luminous component 12 is provided on the housing 11 and configured for luminescent. The battery component 13 is provided on the housing 11. The cover 2 includes two skins 21 and a sewing line 22. The two skins 21 are wrapped around the surface of the luminous ball 1 and form a gap 211. Skins 21 on two sides of the gap 211 are provided with a plurality of sewing holes 212. The sewing line 22 passes through the plurality of sewing holes 212 and sews the gap 211 between the two skins 21. Light emitted by the luminous component 12 passes through the housing 11 and penetrates from the gap 211 between the two skins 21 and each sewing hole 212 to outsides of the skins 21.

The skins 21 used in this embodiment of the present application are the same as a skin 21 used in traditional hard baseball or softball. A distribution path of the sewing holes 212 and the gap 211 provided on the skins 21 follows a distribution path of a red line sewn on the skin 21 of traditional hard baseball or softball. At the same time, a sewing way of the two skins 21 is also the same as that of the skin 21 of traditional hard baseball or softball.

Figure 4:
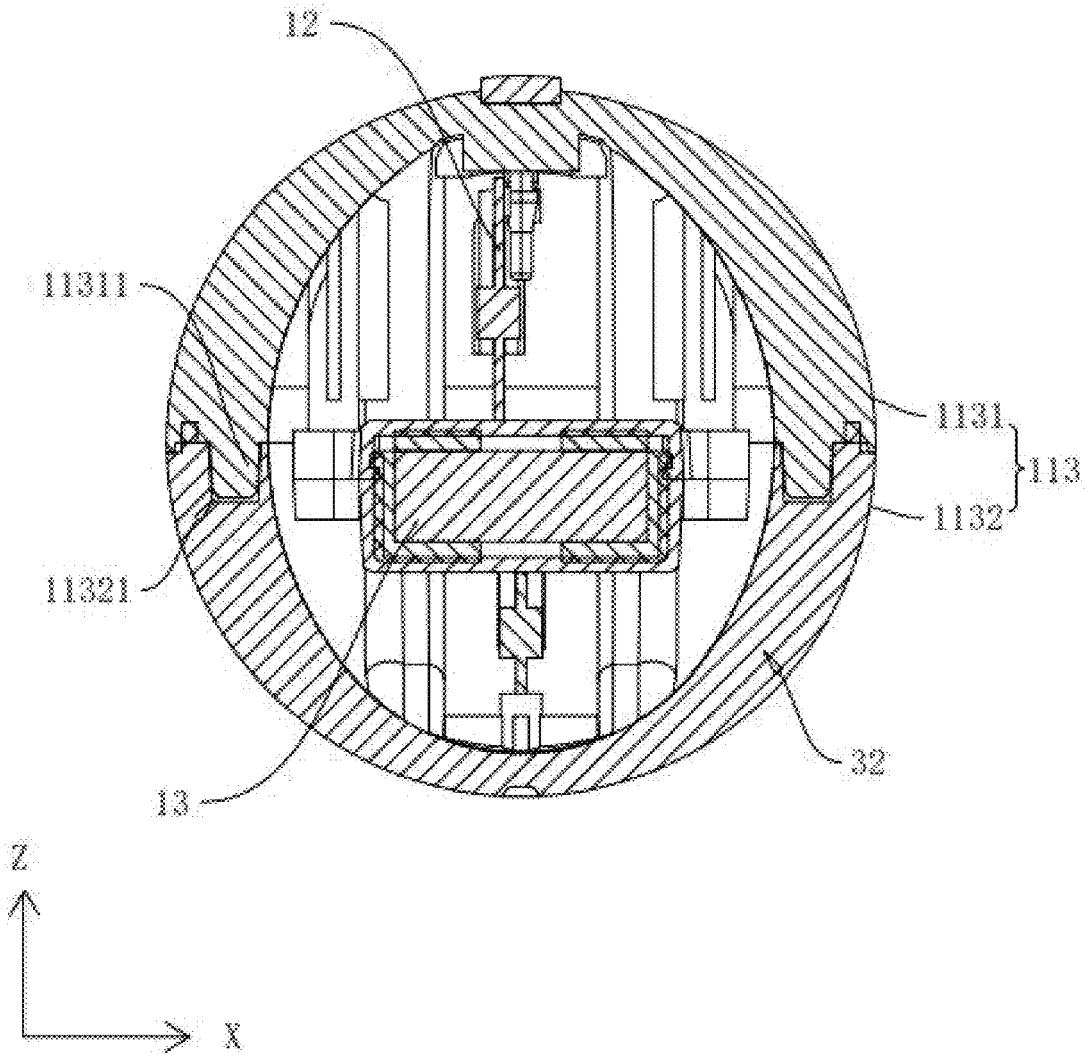
FIG. 4 is a first cross-sectional view of the luminous ball in an embodiment of the present application.
Figure 5:
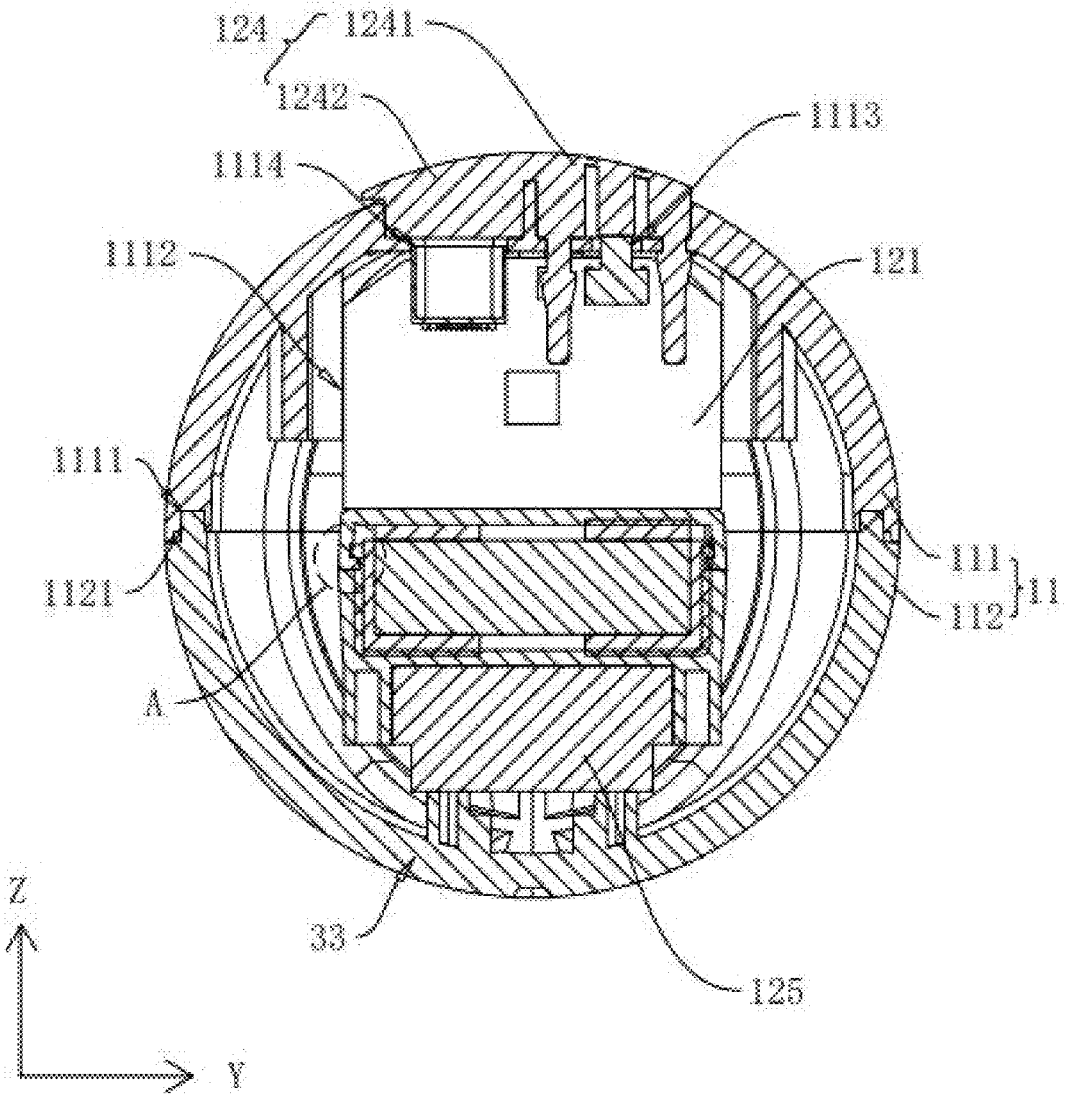
FIG. 5 is a second cross-sectional view of the luminous ball in an embodiment of the present application.

Referring to FIGS. 3 and 4, the housing 11 includes a surface housing 111 and a bottom housing 112. In this embodiment of the present application, a dividing surface between the surface housing 111 and the bottom housing 112 is set as an XY plane 31, which passes through a geometric center of the housing 11. Referring to FIG. 5, a fixed groove 1111 with a circular ring shape is provided on one side of the surface housing 111 close to the bottom housing 112, and a fixed protrusion 1121 with a circular ring shape is fixed on one side of the bottom housing 112 close to the surface housing 111. When the bottom housing 112 and the surface housing 111 are connected, the fixed protrusion 1121 is penetrated through and clamp fixed to the fixed groove 1111. In this embodiment of the present application, a fixing way between the surface housing 111 and the bottom housing 112 uses a hot-pressing connection process, so that the surface housing 111 and the bottom housing 112 are fixed by the hot pressing connection process. Thus, the connection is tight, and a connection area is wide, which renders it difficult for the surface housing 111 and the bottom housing 112 to detach from each other when the housing 11 is subjected by force, thereby ensuring that the luminous component 12 and the battery component 13 remain intact and undamaged when subjected by impact. When the bottom housing 112 and the surface housing 111 are damaged, the luminous component 12 and the battery component 13 continue to be locked and fixed, ensuring the ability of the luminous component 12 and the battery component 13 to continue to use. At the same time, the use process is tool free for snap installation, which does not require any tools to fix the surface housing 111 and the bottom housing 112. Once the surface housing 111 and the bottom housing 112 are pressed together, the surface housing 111 is automatically engaged with the ground, rendering an assembly of the ball core faster and more convenient. This renders the housing 11 less likely to twist during use, ensuring the stability of the flight and operation of the baseball, and thus rendering a flight rotation of the baseball more stable.

Referring to FIGS. 4 and 5, three reinforcing ribs 113 are fixedly provided in the housing 11. A center of gravity of one reinforcing ribs 113 is coincided with a geometric center of the housing 11 and is perpendicular to the XY plane 31. In this embodiment of the present application, a center plane of the reinforcing rib 113 is set as a XZ plane 32, and a plane that is perpendicular to the XZ plane 32 and the XY plane 31 is set as a YZ plane 33. The other two reinforcing ribs 113 have their center planes parallel to the YZ plane 33 and are symmetrically distributed along the YZ plane 33.

Figure 6:
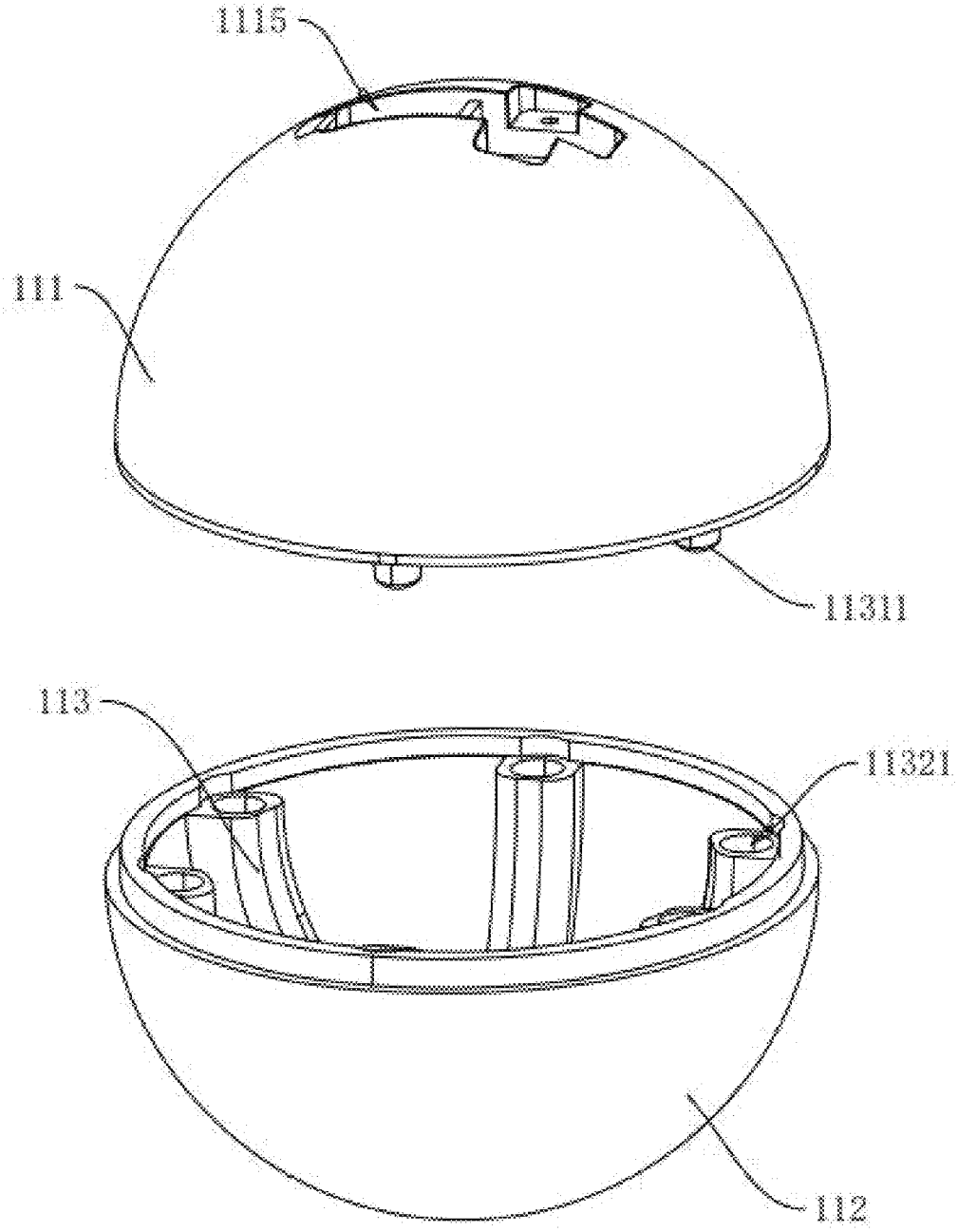
FIG. 6 is an exploded view of a housing in an embodiment of the present application.

Referring to FIGS. 4 and 6, the reinforcing rib 113 includes a first reinforcing portion 1131 and a second reinforcing portion 1132. The first reinforcing portion 1131 is provided on the surface housing 111, and the second reinforcing portion 1132 is provided on the bottom housing 112. The first reinforcing protrusion 11311 is fixedly provided on one side of the first reinforcing portion 1131 close to the second reinforcing portion 1132. The first reinforcing protrusion 11311 is a circular cone with a gradually decreasing diameter size from near the first reinforcing portion 1131 towards near the second reinforcing portion 1132. A reinforcing recess 11321 is provided on one side of the second reinforcing portion 1132 close to the first reinforcing portion 1131. When the surface housing 111 is connected to the bottom housing 112, the first reinforcing protrusion 11311 is penetrated through the reinforcing recess 11321.

Thus, a connection position between the first reinforcing portion 1131 and the second reinforcing portion 1132 still plays an excellent structural strengthening role. At the same time, the providing of the reinforcing rib 113 greatly improves the strength of the housing 11, so that when the luminous ball 1 is impacted, the reinforcing rib 113 will share the pressure subjected by the surface housing 111 and the bottom housing 112, thereby providing additional structural strength for the surface housing 111 and the bottom housing 112, effectively preventing the housing 11 from disassembling under pressure, thus more stably and effectively protecting the luminous component 12 in the housing 11, avoiding damage to the luminous component 12 caused by collision or impact, and an internal space of the housing 11 is tightly matched. At the same time, the surface housing 111 and the bottom housing 112 are thicker, and a plurality of reinforcing ribs 113 are added therein to achieve an effect that the product will not crack, and outside and the internal parts will not be easily damaged when subjected to force, this improvement greatly enhances the durability and endurance of the battery component 13, rendering it better suited for high-intensity sport demands, thereby extending the lifespan of baseball.

Figure 7:
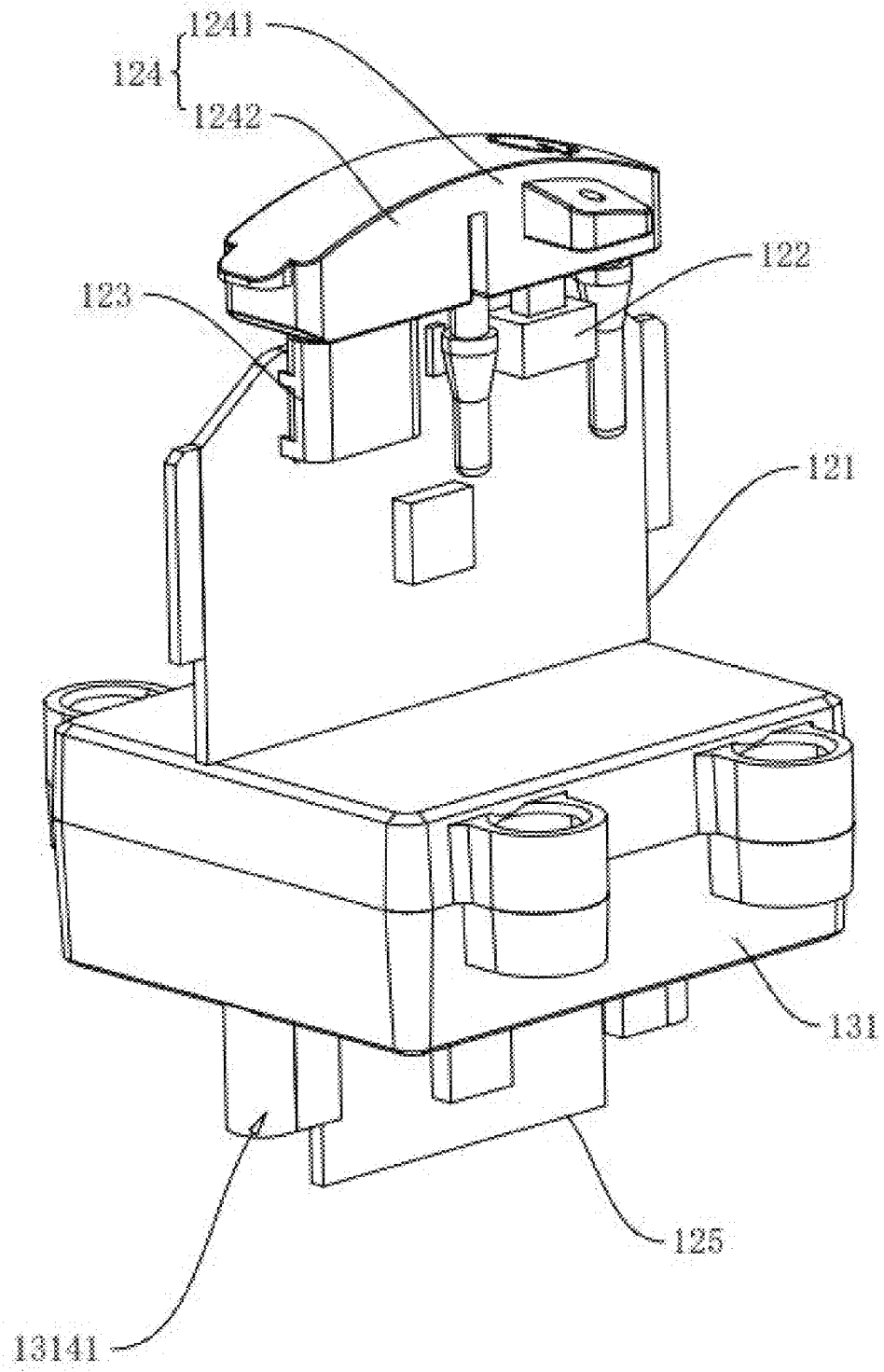
FIG. 7 is an exploded view of a luminous component in an embodiment of the present application.

Referring to FIGS. 1 and 7, the luminous component 12 includes a first luminous plate 121 located on one side of the surface housing 111. A horizontal center plane of the first luminous plate 121 is parallel to but not coincident with the YZ plane 33. A center plane in a thickness direction of the first luminous plate 121 is parallel to and coincides with the XZ plane 32, and a weight of the first luminous plate 121 is symmetrically distributed along the XZ plane 32. The surface housing 111 is provided with two first clamp grooves 1112 extending in the Z direction, and the two first clamp grooves 1112 are symmetrically distributed along the XZ plane 32 and directly facing two sides of the first luminous plate 121. Two sides of the first luminous plate 121 are penetrated through and clamp fixed to the two first clamp grooves 1112. In this embodiment of the present application, the first luminous plate 121 is a circuit board and a surface of the first luminous plate 121 is fixed and electrically connected with a luminous module.

Referring to FIGS. 1 and 7, the luminous component 12 further includes an on-off switch 122 and a charging module 123. The on-off switch 122 and the charging module 123 are both fixed and electrically connected to one side of the first luminous plate 121 close to the surface housing 111. The weights of the on-off switch 122 and the first luminous plate 121 are symmetrical along the YZ plane 33. The surface housing 111 is provided with a switch port 1113 and a charging port 1114 that are penetrated through. The on-off switch 122 is penetrated through the switch port 1113, and the charging module 123 is penetrated through the charging port 1114.

Referring to FIGS. 1 and 7, the providing of the on-off switch 122 and the charging module 123 simplifies an internal structure of the luminous ball 1, thereby eliminating a need for frequent disassembly or assembly of the luminous component 12 and the battery component 13 during use, greatly improving a convenience of use, enhancing the usability of the product, and improving the user experience.

Referring to FIGS. 1 and 7, the luminous component 12 further includes a rubber protection block 124, which includes a switch protection part 1241 and a charging protection part 1242. The switch protection part 1241 and the charging protection part 1242 are fixedly connected, and a protection groove 1115 is provided at a top of the surface housing 111 away from the bottom housing 112. The protection groove 1115 is connected to the switch port 1113 and connected to the charging port 1114. The rubber protection block 124 is penetrated through the protection groove 1115, and the switch protection part 1241 is fixedly connected to the protection groove 1115 and abuts against the on-off switch 122. The charging protection part 1242 closes the charging port 1114. The weights of the rubber protection block 124, the on-off switch 122, and the charging module 123 are symmetrical along the XZ plane 32.

At the same time, the providing of the rubber protection block 124 enables the opening or closing of the luminous component 12 to be controlled externally by directly pressing the switch protection part 1241 outside the luminous ball 1.

Referring to FIGS. 1 and 7, the luminous component 12 further includes a second luminous plate 125, which is located on one side of the bottom housing 112. One end of the second luminous plate 125 close to the bottom housing 112 abuts against bottom housing 112. The second luminous plate 125 is parallel to a horizontal plane of the first luminous plate 121, and its weight is symmetrically distributed along the XZ plane 32 and YZ plane 33. The first luminous plate 121 and the second luminous plate 125 are respectively located on two sides of the housing 11, rendering the light distribution emitted by the luminous component 12 more uniform and symmetrical, thereby improving the luminous effect of the baseball.

Figure 8:
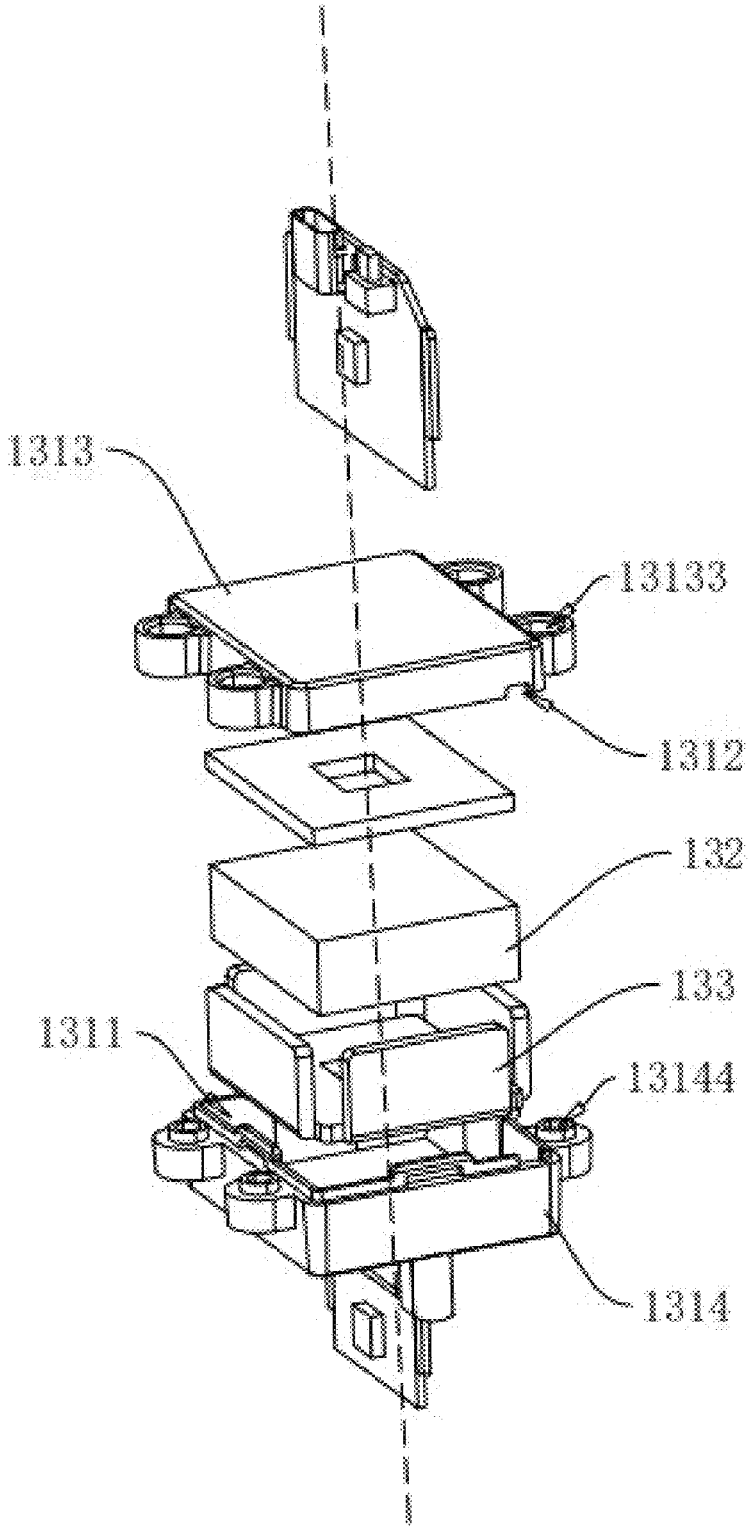
FIG. 8 is an exploded view of a battery module in an embodiment of the present application.

Referring to FIGS. 1 and 8, the battery component 13 includes a battery shell 131 and a battery module 132. The battery shell 131 is fixedly provided on the surface housing 111, and the battery shell 131 is made of fire-resistant material. A protection chamber 1311 is provided in a middle of the battery shell 131, and a connection groove 1312 that is penetrated through is provided on the battery shell 131. The connection groove 1312 is connected to the protection chamber 1311, and the battery module 132 is clamp fixed to the protection chamber 1311 and electrically connected to the luminous component 12 through wires that pass through the connection groove 1312. The centers of gravity of the battery shell 131 and the battery module 132 are biased towards one side of the bottom housing 112.

In this embodiment of the present application, the first luminous plate 121 and the second luminous plate 125 use high-efficiency light sources, and the battery module 132 uses a 650 mhA battery configuration, which extends the luminous time of the luminous ball 1 and ensures that the luminous effect of the luminous ball 1 remains significantly stable even after long-term use, thereby effectively ensuring the stability and durability of the luminous effect and meeting the needs of long-term movement in nighttime or low light environments.

Figure 9:
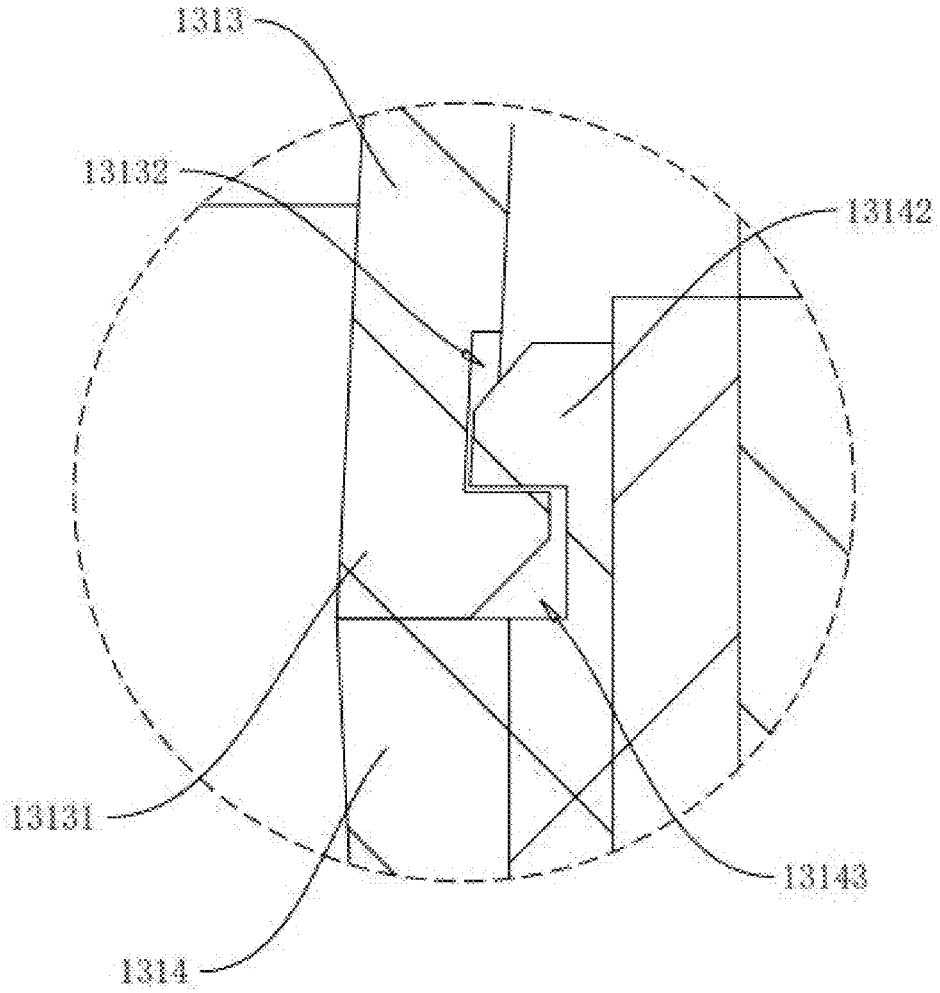
FIG. 9 is an enlarged view of part A of FIG. 5.

Referring to FIGS. 8 and 9, the battery shell 131 includes a first shell part 1313 and a second shell part 1314. The first shell part 1313 and the second shell part 1314 are connected. The first shell part 1313 is located on one side of the surface housing 111, and the second shell part 1314 is located on one side of the bottom housing 112. One side of the first shell part 1313 far away from the second shell part 1314 abuts against the first luminous plate 121, and one side of the second shell part 1314 far away from the first shell part 1313 abuts against the second luminous plate 125. The second shell part 1314 is provided with two parallel second clamp groove 13141, which are respectively located on two sides of the second luminous plate 125. The two sides of the second luminous plate 125 are respectively penetrated through and clamped into the two second clamp grooves 13141.

Referring to FIGS. 8 and 9, the first shell part 1313 is fixedly provided with a first protrusion 13131 and provided with a first recess 13132, the second shell part 1314 is fixedly provided with a second protrusion 13142 and provided with a second recess 13143. When the first shell part 1313 abuts against the second shell part 1314, the first protrusion 13131 is penetrated through and clamp fixed to the second recess 13143, and the second protrusion 13142 is penetrated through and clamp fixed to the second recess 13143, thereby further increasing a stable connection between the first shell part 1313 and the second shell part 1314, and thus improving the protection of the battery module 132 by the battery shell 131.

Referring to FIGS. 8 and 9, the first shell part 1313 is provided with a plurality of first fixing holes 13133 that are penetrated through, and the second shell part 1314 is provided with a plurality of second fixing holes 13144 that are penetrated through. When the second shell part 1314 abuts against the first shell part 1313, each of the second fixing holes 13144 corresponds to and communicates with each of the first fixing holes 13133. Both the first shell part 1313 and the second shell part 1314 are fixedly connected to the surface housing 111 through a fastener, and each fastener is simultaneously penetrated through each of the second fixing holes 13144 and each of the first fixing holes 13133 and fixedly connected to the surface housing 111. Each fastener tightly fixes the second shell part 1314 to the first shell part 1313, thereby ensuring that a tight assembly of the battery shell 131 and further increases the stable connection between the first shell part 1313 and the second shell part 1314, rendering it less likely for the first shell part 1313 and the second shell part 1314 to be fallen off during use. The fasteners used in this embodiment of the present application are screws.

Referring to FIGS. 8 and 9, the battery component 13 further includes a sponge pad 133, which is provided between the battery module 132 and the battery shell 131. One side of the sponge pad 133 abuts against the battery shell 131, and the other side of the sponge pad 133 abuts against the battery module 132. When the baseball is used and hit, the sponge pad 133 will absorb a vibration of the luminous ball 1, thereby ensuring that the luminous component 12 and the battery component 13 in the housing 11 are not easily damaged even under high-intensity impact, thereby reducing the possibility of combustion of the battery module 132.

Referring to FIGS. 3, 4, and 5, after the surface housing 111 is connected to the bottom housing 112, the weight is self symmetrically balanced along the XY plane 31, so that a center of gravity and a geometric center of the housing 11 are coincided. The first luminous plate 121 in the luminous component 12 is self symmetrically balanced on the XZ plane 32, and the weight of the first luminous plate 121 is symmetrically balanced with the on-off switch 122 in the YZ plane 33. The weight of the first luminous plate 121 is symmetrically balanced with the battery shell 131, the battery module 132, and the second luminous plate 125 in the XY plane 31. The weights of the on-off switch 122, the charging module 123, and the rubber protection block 124 are symmetrically balanced along the YZ plane 33, ensuring that the center of gravity of the baseball is located on the geometrical center of the luminous ball 1 through precise layout and symmetrical design of the luminous component 12 and battery component 13. The geometric center of the luminous ball 1 avoids a problem of center of gravity shift caused by additional structures, and a large number of uniform distribution methods are adopted to render the weight distribution of the entire baseball balanced, ensure that the baseball maintains a stable trajectory during throwing and spinning, effectively preventing shaking or irregular rotation during high-speed throwing, rendering a flight path of the baseball easier to predict, and balancing the weight renders it easier for the user to control or grip the baseball.

An implementation principle of the rechargeable baseball core in the present application is as follows: when the battery module 132 self-ignites due to being hit or vibrating, flame generated by the self-ignition of the battery module 132 is isolated by the battery shell 131 due to its fireproof characteristics, rendering it difficult for the flame generated by the self-ignition of the battery module 132 to ignite the battery shell 131 and continue to spread, thereby achieving a goal of preventing flame spread. This improves a direct electrical connection between the battery and the luminous device, which can easily cause the flame generated by the self-ignition of the battery to ignite the luminous device when the battery self-ignites, and finally spray out from a receiving space to ignite the entire baseball, which can easily cause greater losses. At the same time, when the temperature in the battery chamber is too high, it is easy to melt the wires that are electrical connecting the battery module 132 and the luminous component 12. Thereby achieving automatic power-off protection for overheating of the battery component 13.

The above are preferred embodiments of the present application and do not limit the protection scope of the present application. Therefore, any equivalent changes made according to the structure, shape, and principle of the present application should be included in the protection scope of the present application.

What is claimed is:

1. A rechargeable baseball core, comprising a luminous ball and a cover covering a surface of the luminous ball;

the luminous ball comprises a housing, a luminous component, and a battery component;

the luminous component is provided on the housing and configured for luminescent;

the battery component comprises a battery shell and a battery module;

the battery shell is fixedly provided on the housing and is made of fire-resistant material;

the battery shell is provided with a protection chamber and a connection groove that is penetrated through;

the connection groove communicates to the protection chamber, and the battery module is clamped and fixed in the protection chamber and electrically connected to the luminous component through wires in the connection groove;

wherein the luminous component comprises a first luminous plate and a second luminous plate, the first luminous plate and the second luminous plate are respectively located on two sides of the battery shell, the first luminous plate and the second luminous plate are both abutted against the battery shell, and the first luminous plate and the second luminous plate are both electrically connected to the battery module.

2. The rechargeable baseball core according to claim 1, wherein the battery shell comprises a first shell part and a second shell part, the first shell part is fixedly provided with a first protrusion and provided with a first recess, the second shell part is fixedly provided with a second protrusion and provided with a second recess, when the first shell part abuts against the second shell part, the first shell part is penetrated through and clamp fixed in the second recess, and the second protrusion is penetrated through and clamp fixed in the second recess.

3. The rechargeable baseball core according to claim 2, wherein the first shell part is provided with a plurality of first fixing holes that are penetrated through, and the second shell part is provided with a plurality of second fixing holes that are penetrated through;

when the second shell part abuts against the first shell part, each of the second fixing holes corresponds to and communicates with each of the first fixing holes;

the first shell part and the second shell part are both fixed to the housing by a fastener, each fastener is simultaneously penetrated through each of the first shell part and the second shell part and fixedly connected to the housing, and each fastener is tightly abutted against the second shell part.

4. The rechargeable baseball core according to claim 1, wherein the battery component further comprises a sponge pad, the sponge pad is provided between the battery module and the battery shell, one side of the sponge pad abuts against the battery shell, and the other side of the sponge pad abuts against the battery module.

5. The rechargeable baseball core according to claim 1, wherein at least one reinforcing rib is fixedly provided in the housing.

6. The rechargeable baseball core according to claim 5, wherein the housing comprises a surface housing and a bottom housing, the reinforcing rib comprises a first reinforcing portion and a second reinforcing portion, the first reinforcing portion is provided on the surface housing, the second reinforcing portion is provided on the bottom housing, the first reinforcing portion is fixedly provided with a reinforcing protrusion, the second reinforcing portion is provided with a reinforcing recess, when the surface housing is connected to the bottom housing, the reinforcing protrusion is penetrated through the reinforcing recess.

7. The rechargeable baseball core according to claim 1, wherein the housing is provided with a first clamp groove, the first luminous plate is penetrated through and clamp fixed in the first clamp groove, the battery shell is provided with a second clamp groove, and the second luminous plate is penetrated through and clamp fixed in the second clamp groove.

8. The rechargeable baseball core according to claim 1, wherein the first luminous plate is electrically connected with an on-off switch and a charging module, the housing is provided with a switch port and a charging port, the on-off switch is penetrated through the switch port, the charging module is penetrated through the charging port, the luminous component further comprises a rubber protection block, the rubber protection block comprises a switch protection part and a charging protection part, the switch protection part and the charging protection part are fixedly connected, and the switch protection part is fixedly connected to the housing and abuts against the on-off switch, the charging protection part closes the charging port.

9. The rechargeable baseball core according to claim 1, wherein a center of gravity of the luminous ball is coincided with a center of the luminous ball.

* * * * *